US011101085B2

(12) United States Patent
Ruff

(10) Patent No.: US 11,101,085 B2
(45) Date of Patent: Aug. 24, 2021

(54) KEY MODULE

(71) Applicant: CHERRY GMBH, Auerbach (DE)

(72) Inventor: Eduard Ruff, Auerbach (DE)

( * ) Notice: Subject to any disclaimer, the term of this patent is extended or adjusted under 35 U.S.C. 154(b) by 0 days.

(21) Appl. No.: 16/496,344

(22) PCT Filed: Mar. 22, 2018

(86) PCT No.: PCT/EP2018/057314
§ 371 (c)(1),
(2) Date: Sep. 20, 2019

(87) PCT Pub. No.: WO2018/172468
PCT Pub. Date: Sep. 27, 2018

(65) Prior Publication Data

US 2020/0043680 A1 Feb. 6, 2020

(30) Foreign Application Priority Data

Mar. 24, 2017 (DE) ..... 10 2017 106 406.0

(51) Int. Cl.
*H01H 13/70* (2006.01)
*H01H 13/705* (2006.01)
(Continued)

(52) U.S. Cl.
CPC ..... *H01H 13/705* (2013.01); *H01H 13/06* (2013.01); *H01H 13/14* (2013.01)

(58) Field of Classification Search
CPC ..... H01H 13/705; H01H 13/06; H01H 13/14
(Continued)

(56) References Cited

U.S. PATENT DOCUMENTS 8,089,014 B2 * 1/2012 Maeda ..... H01H 13/06 200/302.1
2012/0103774 A1 * 5/2012 Jun ..... H01H 3/022 200/345

(Continued)

FOREIGN PATENT DOCUMENTS

CN 203339029 * 12/2013 ..... H01H 3/83
FR 2620563 * 3/1989 ..... H01H 13/705

OTHER PUBLICATIONS

International Search Report for PCT/EP2018/057314, dated May 24, 2018.

(Continued)

*Primary Examiner* — Edwin A. Leon
*Assistant Examiner* — Iman Malakooti
(74) *Attorney, Agent, or Firm* — James R. Hayne; Stites & Harbison PLLC

(57) ABSTRACT

What is presented is a key module (100) with a cover element (110) and a tappet (105) having a cam nose (135), wherein the tappet (105) is supported to be movable along a movement axis (200) by the cover element (110), wherein the tappet (105) has a cylindrical keycap supporting portion (160) in a passage area (210) in which it projects through the cover element (110) and has at least one rib (170) on a guiding portion (165) adjacent to the an keycap supporting portion (160) on an outside (167). Furthermore, the key module (100) includes a contactor unit (115) formed and arranged to be taken along by the cam nose (135), and a contact piece (120) formed and arranged for establishing electric contact with the contact nose (140). Moreover, the key module (100) has a housing element (130) for accommodating the contact piece (120), the contactor unit (115) and the tappet (105), wherein the housing element (130) has, for accommodating the guiding portion (165) of the tappet
(Continued)

(105), at least one accommodating bowl (175) with at least one recess (1100) for accommodating the at least one rib (170) of the tappet (105).

16 Claims, 15 Drawing Sheets

(51) Int. Cl.
*H01H 13/06* (2006.01)
*H01H 13/14* (2006.01)

(58) Field of Classification Search
USPC ..... 200/345
See application file for complete search history.

(56) References Cited

U.S. PATENT DOCUMENTS

| | | | | |
|---|---|---|---|---|
| 2013/0199909 | A1* | 8/2013 | Young | H01H 13/14 200/345 |
| 2014/0291134 | A1* | 10/2014 | Whitt, III et al. | H01H 13/704 200/5 A |
| 2016/0049264 | A1 | 2/2016 | Muller | |
| 2018/0240622 | A1 | 8/2018 | Yuan et al. | |

OTHER PUBLICATIONS

Written Opinion of the International Searching Authority for PCT/EP2018/057314, dated May 24, 2018.

* cited by examiner

KEY MODULE

The present invention relates to a key module according to the main claims. The key module may be used in a computer keyboard, for example.

Most available key modules (which may also referred to as key module) are relatively high and hard to integrate into the flat keyboards or notebooks. In usual modules, also a "clicking" is variant is realized on the basis of the two-part tappet, in order to output an indication of an actuated key to a user of the key module. In flat key modules, the clicking sound is realized by means of an additional mechanism due to the lack of available space. Consequently, electric switching process is decoupled from the process of producing the clicking sound and thus does not take place synchronously with the production of the clicking sound. Also, LED illumination is designed from one side in most known key modules so that uniform illumination of a surface facing the user of the key module is not possible with one LED (in particular keys with two or three symbols). Furthermore, most key modules are designed to be relatively untight for cost reasons so that damage to the keyboards quickly occurs when water or watery liquids are spilt, for example. The weak spots in the key module with respect to damage caused by liquids especially are the electric switching mechanism and guidance of the tappet. Moreover, on the part of the user, there is often a need for different key modules, for example with a linear force path upon actuation, with a pressure point for actuation, with a clicking sound upon actuation and with various force-displacement characteristics. However, such variety necessitates an enormous variety of variants of key modules, which mostly are to be produced in different modes of production and thus at high cost, to be kept available by the key manufacturers. Also, the guidance of the tappet in low modules upon actuation of such a key module is shortened, which increases the likelihood of canting of the key. In a so-called "silent" design of a key module, an expensive two-component tappet is used, which significantly increases the overall module cost. Also, reduced constructional height makes electronic devices (especially when using SMD-based components) hard or impossible to mount the upper side of a circuit board, in particular in connection with frame assembly. Moreover, assembly on the bottom side of the key modules also is problematic because certain components should be directly attached to the modules. Significant difficulties result therefrom in a subsequent module soldering process (especially when using a solder wave), because all components need to be covered. In addition, there is the risk of destruction of the electronic devices due to electrostatic discharge (of up to 8 KV).

Against this background, the present invention provides an improved key module according to the main claims. Preferred embodiments are obvious from the dependent claims and the subsequent description.

The approach presented here provides a key module comprising:

- a cover element,
- a tappet comprising a cam nose, wherein the tappet is supported to be movable along a movement axis by the cover element, wherein the tappet comprises a cylindrical keycap supporting portion in a passage area in which it projects through the cover element and comprises at least one rib on a guiding portion adjacent to the an keycap supporting portion on an outside;
- a contactor unit formed and arranged to be taken along by the cam nose;

- a contact piece formed and arranged for establishing electric contact with the contact nose; and
- a housing element for accommodating the contact piece, the contactor unit and the tappet, wherein the housing element comprises, for accommodating the guiding portion of the tappet, at least one accommodating bowl with at least one recess for accommodating the at least one rib of the tappet.

The cam nose may be seen as a protrusion of the tappet, for example, which engages behind another element and takes it along in the case of movement in the direction of the actuation axis. An actuation axis may be an axis along which the tappet is moved or movable with respect to the cover element and/or to the housing element. A contact piece may be seen as an element at least partially consisting of electrically conductive material and fixed at a predetermined position housing element, for example. A contactor unit may be seen as one element. The contact piece may serve as a counter-piece with respect to the contactor unit, for example, in order to close an electric contact in the form of a switch. A keycap supporting portion may be a portion of the tappet, for example, under which a keycap may be plugged, which keycap bears a symbol, for example, to indicate the user which key to press when it is desired to input a certain symbol. A guiding portion may be seen as a portion of the tappet pressed into the housing element when the tappet is being depressed. A real may be a protruding wall or wing protruding laterally from the guiding portion and guided in a recess or slotted opening of an accommodating bowl of the housing element, when the guiding portion is inserted into the accommodating bowl of the housing element when the tappet is being depressed.

The approach proposed here is based on the finding that a very undisturbed actuation of the tappet along the actuation axis without getting jammed can be enabled by the cylindrical keycap supporting portion, which advantageously is guided a circular opening of the cover element, as well as the design of the guiding portion with the rib or the ribs, which is guided in a corresponding recess or one recess each accommodating bowl of the housing element. It can be ensured that both an upper region of the tappet is guided securely and reliably by the keycap supporting portion and a lower region of the tappet is guided securely and reliably by the mentioned design of the guiding portion. Furthermore, the special designs may also be produced by technically simple means.

What is advantageously is an embodiment of the approach proposed here in which the tappet comprises at least a plurality of ribs on its outside, which are arranged in particular in a cruciform manner, wherein the accommodating bowl of the housing element comprises a plurality of recesses, which are each formed to accommodate one of the ribs of the tappet. Such of the approach proposed here offers the advantage of an especially beneficial lock against a rotation by the use of a plurality of ribs extending from the outside of the tappet into a corresponding recesses of the accommodating bowl and supported on the sidewalls of these recesses.

What is particularly beneficial is an embodiment of the approach described here in which the tappet comprises an at least partially hollow-cylindrical portion in the region of the guiding portion, in particular wherein the at least one rib is formed on an outside of the hollow-cylindrical portion. Such an embodiment of the approach proposed here offers the possibility of keeping the height of the at least one rib small so that bending or breaking of the rib can be prevented. In addition, such a hollow-cylindrical portion offers advantages with regard to the stability of the guiding portion of the tappet.

So as to further reduce canting of the tappet upon depression along the actuation axis, a guiding piston of the housing element may engage the hollow-cylindrical portion of the guiding portion of the tappet, according to a further embodiment of the approach proposed here.

The thinner the wall thickness of the at least one rib, the narrower may be the recess in the accommodating bowl, so that the tappet hereby can be guided very well and free from canting when being depressed along the actuation axis. For this reason, another embodiment of the approach proposed here is very advantageous, wherein the rib of the tappet has a wall thickness which at most is half of a diameter of the keycap supporting portion, in particular at most one third of the diameter of the keycap supporting portion.

According to a further embodiment of the approach proposed here, the contactor unit may comprise a contact nose movable in the direction of the actuation axis and transverse with respect to the direction of the actuation axis, wherein the housing element comprises a guiding wall oriented obliquely with respect to the direction of the actuation axis and formed to deflect the contact nose from a rest position adjacent to the contact piece in the direction along and/or transverse to the actuation axis, when the contact nose is taken along by the cam nose when the tappet is being depressed.

The contactor unit may comprise a contact nose movable in various directions, wherein the contact nose may be seen as a region of the contactor unit in which electric contact to a corresponding counterpart may be closed. A guiding wall may be seen as a strut or surface, for example, formed to deflect the contact nose in a direction along and/or transverse to the actuation axis, when the contact nose is taken along by the cam nose and deflected on the guiding wall when the tappet is moving along the actuation axis.

Such an embodiment of the approach proposed here is based on the finding that, by using the cam nose or the tappet in a movement of the tappet along the movement axis, i.e. when depressing the tappet, the contact nose, as the region of the contactor unit designed so as to be the most movable one, is taken along and guided along the guiding wall until the contact nose is laterally deflected by sliding on the guiding wall so far that it slides laterally past the cam nose and hereby is released so as to snap back into its original position, i.e. the rest position. Hereby, on the one hand a clicking noise can be generated, which is very close in time to electrically contacting the contact nose with the contact piece, so that the clicking sound may also be perceived as very promptly as confirmation of the electric contact between two electric contacts by a user of the key module. The approach presented here offers the advantage that constructive effort of equipping the key module with a unit for producing the clicking sound can be avoided by deflecting and snapping back of the contact nose of the contactor unit as a part of an electric contact switch. In this way, a key module which is inexpensive and simple to manufacture, yet still has the advantages mostly highly valued by users can be provided.

According to a special embodiment of the approach presented here, the housing element may be formed to guide the contact nose around the cam nose when the tappet is being depressed. Such guiding around may mean that the contact nose has the greatest distance to the movement axis at the time of this guiding around, for example. In this manner, the contact nose may be released very easily and at a defined distance, in order to both produce the clicking sound after snapping back and ensure the electric connection in a reversibly repeatable way after depressing the tappet by a certain distance.

What is also advantageous is an embodiment of the approach presented here wherein the contactor unit is formed to hit the contact nose on the cover element after a deflection on the guiding wall. Such an embodiment offers the advantage of forming a defined strike surface on the cover element, which may be both reinforced correspondingly and structured correspondingly for producing a certain sound and connected to further regions of the cover element.

What is also advantageous is an embodiment of the approach presented here in which the contactor unit at least partially comprises a U-shaped portion, in particular wherein the contact nose is arranged on one end of the U-shaped portion of the contactor unit, and/or wherein a U-shape of the contactor unit is formed in a plane oriented substantially perpendicularly with respect to the movement axis. Such an embodiment of the approach proposed here offers the advantage of a contactor unit being very easy to realize technically, yet having the contact nose with corresponding desired mobility various directions of. For example, the contactor unit may be formed as a correspondingly shaped bent metal strip.

What is also conceivable is an embodiment of the approach presented here in which the contactor unit has (mechanical) stiffness greater with respect to movement of the contact nose in the direction of the movement axis then in the direction transverse to the movement axis. Such an embodiment of the approach proposed here offers the advantage that the contact nose moves significantly more quickly in the direction of the movement axis than transverse to the movement axis when moving back after being guided around over the cam nose. In this way, it is ensured that the clicking sound is caused substantially by movement in the direction of the movement axis, which is designed clearly reproducibly and offers sufficient snapping path for the contact nose so as to generate the clicking sound in a clearly perceptible manner for the user.

According to another embodiment of the approach proposed here, the contactor unit may have, in the region of the contact nose, a surface portion the surface of which is oriented obliquely with respect to the direction of the movement axis, in particular the surface of which at most is oriented at an acute angle with respect to the guiding wall, in particular the surface of which is aligned in parallel with the guiding wall. This surface portion may be formed and arranged to slide along on the guiding wall. Such an embodiment of the approach presented here offers the advantage of particularly low-friction sliding of the surface portion on the guiding wall. In this way, it is achieved that the key module can be actuated with as little force as possible and reliably.

What is particularly reliable and long-life is an embodiment of the approach proposed here in which the contactor unit comprises, in the region of the contact nose, a strike portion formed to strike on the cover element. In particular, the strike portion may comprise a surface aligned substantially in parallel with the cover element or part of the cover element, and/or wherein the strike portion is formed by an angled part of the contactor unit or the contact nose, and/or wherein the strike portion has a length of a surface oriented toward the cover element greater than a thickness.

So as to ensure quick and repeated actuation of the key module, the return movement of the tappet along the movement axis should take place as unhindered as possible or only with little hindrance. What is particularly advantageously is an embodiment of the approach proposed here in which the cam nose of the tappet comprises at least one reset surface portion, which comprises a surface oriented obliquely with respect to the direction of the movement axis, in particular wherein the reset surface portion is formed to guide the contact nose around the cam nose upon a reset of the tappet. In this way, it can be ensured that the contact nose or the contact tip can be guided around the cam nose easily and without increased effort when the tappet moves back to the rest position. In addition, there is the possibility of producing a clicking sound also in the reset of the tappet, in this case for example when the contact nose is lifted from the contact piece and is guided back onto the contact piece after being guided around the cam nose.

What is particularly advantageously is an embodiment of the approach proposed here in which the cover element has a cover slope with a surface oblique with respect to the direction of the movement axis in the region of an opening through which the tappet is guided, and/or wherein the tappet has a tappet slope with a surface oblique with respect to the direction of the movement axis in a passage area surrounded by the cover element. In particular, the cover slope may be arranged circumferentially around the opening in the cover element. Alternatively or additionally, the tappet slope may also be arranged circumferentially around the tappet in the passage area. Such an embodiment offers the advantage of a particularly tight lock between the cover element and the tappet, in particular for avoiding entry of the liquids into the key module.

What is particularly well protected against entry of liquids is a key module according to an embodiment of the approach presented here in which a sealing element arranged between the cover element and the housing element is provided, in particular wherein the sealing element is arranged or press-fit in a groove of the cover element and/or a groove of the housing element. In such an embodiment, in particular, capillary action can be utilized to prevent the liquid from entering the key module.

In an embodiment of the approach proposed here which offers particularly great protection against liquids entering the key module, the sealing element may close the region of the tappet, of the contactor unit and of the contact piece in a fluid-tight manner, in particular wherein the sealing element is formed in the shape of a labyrinth seal or as a labyrinth seal. Hereby, a hermetic seal of the components most important for the function of the key module can be achieved with little cost of materials.

According to another embodiment of the approach proposed here, the cover element may comprise at least one light guiding element, in particular wherein the light guiding element is formed at least partially annularly around a region in which the tappet is guided through the cover element. Such an embodiment offers the advantage of a particularly good possibility of eliminating a keycap to be put on the key module, so that the user can recognize the meaning of the symbols on the keycap quickly, unequivocally and reliably.

So as to ensure maximum protection against canting of the tappet when being depressed, according to a further embodiment, the tappet may comprise ribs or wings protruding on at least a subsection of its outer surface, which are formed crosswise, in particular, and the cover element and/or the housing element may comprise recesses for accommodating the ribs or wings of the tappet.

A key module according to a further embodiment can be made particularly low-noise by providing a shock absorber element arranged between the tappet and the housing element, in particular wherein the shock absorber element is formed to be cylindrical or annular. Such an embodiment of the approach proposed here offers the advantage of using standardized conventional components, such as rubber stoppers, whereby an inexpensive variant of the low-noise key module can be produced.

The invention shall be explained in greater detail by way of example on the basis of the attached drawings, in which.

In the subsequent description of preferred embodiments of the present invention, the same or similar reference numerals shall be used for similarly acting elements illustrated in the various figures, wherein repeated description of these elements shall be omitted.

Figure 1:
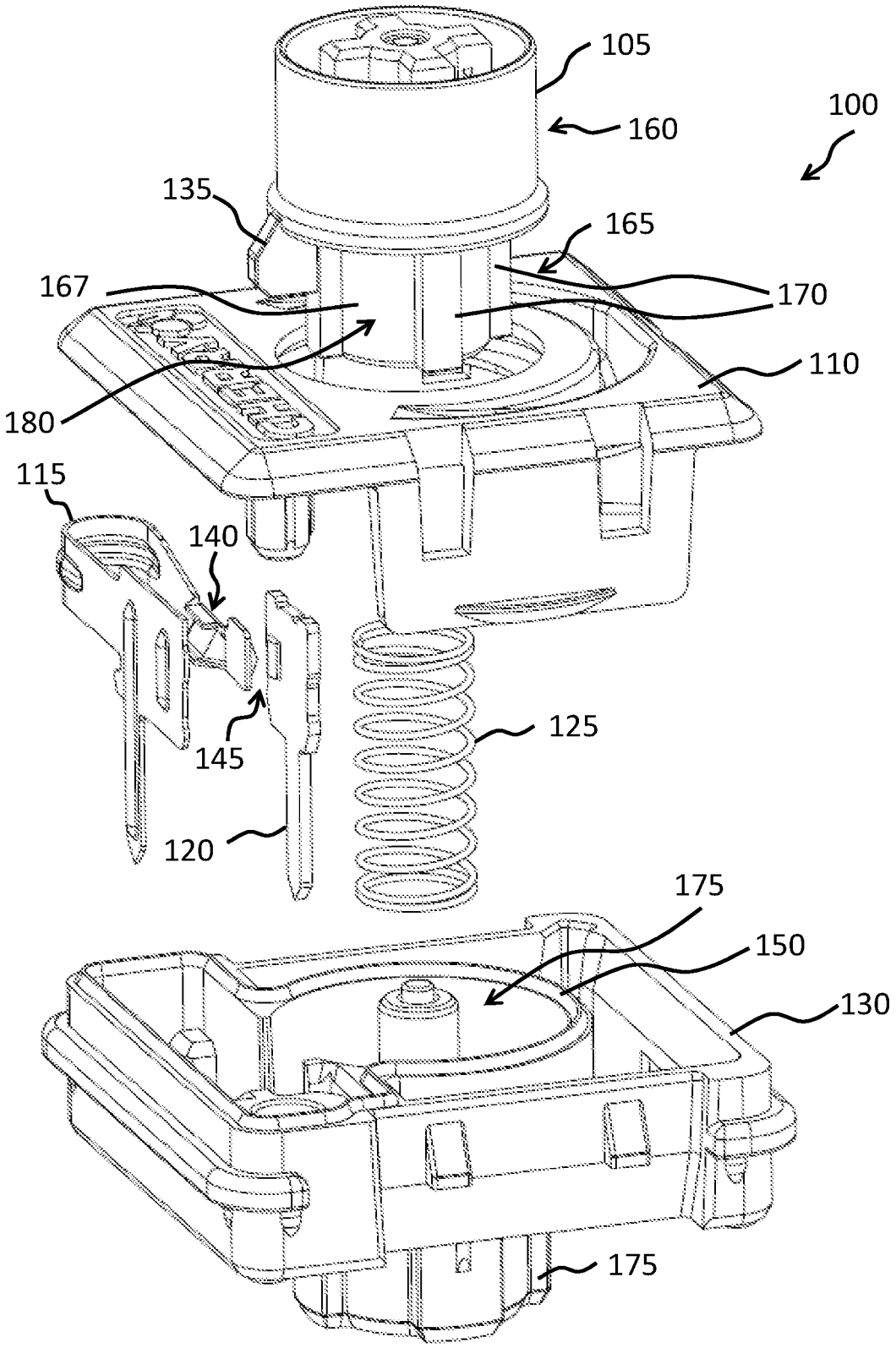
FIG. 1 shows an exploded view of a key module according to an embodiment of the present invention.

FIG. 1 shows an exploded view of a key module 100 according to an embodiment of the present invention. The key module 100 may be constructed as a modular construction set and substantially includes tappet 105, cover element 110, contactor unit 115, contact piece 120, compression spring 125 and housing unit 130 as components. The tappet 105 includes a camp knows 135, which can take along a contact nose 140 of the contactor unit 115 and deflect the same from a rest position, as will be explained in greater detail in the subsequent description. In the present case, the contactor unit 115 is formed as a U-shaped metal element and thus is electrically conductive. The contact nose 140 is arranged in one end of the contactor unit 115 and includes further components described in greater detail in the following apart from a contact tip 145, via which an electric contact between the contactor unit 115 and the contact piece 120 can be closed. Furthermore, it can be seen that the key module 100 illustrated in FIG. 1 includes a sealing element 150, which is set on the housing unit 130 and thus enables fluid-tight closure or inclusion of the contactor unit 115, the bottom part of the tappet 105, in particular the cam nose 135, so as to hereby protect or ensure the operability of the key module 100 as well as possible against liquids acting from the outside. For example, the sealing element 150 may be formed circumferentially and/or have a triangular cross-sectional profile, in order to engage a groove in the cover element 110. illustrated in FIG. 1 and hereby cause optimum seal effect. In the embodiment illustrated in FIG. 1, the compression spring 115 is a helical coil spring, for example of metal; but it is also conceivable to use an alternative spring element, such as a plastics spring or a fluid-filled pad, in order to return the tappet 115 into its original position again after depressing.

The key module 100 may be realized inexpensively in three variants in terms of function. Substantially, what changes is especially the actuation nose on the tappet 105, which is also referred to as cam nose 135 here, and in part a contour wall in the housing element 130, subsequently also referred to as guiding wall.

The tappet to 105 further comprises a cylindrical keycap supporting portion 160 (onto which a symbol-bearing keycap not illustrated in FIG. 1 is clipped) in a passage area in which it projects through the cover element 110. Moreover, the tappet 105 comprises at least one rib 170 on a guiding portion 165 adjacent to the keycap supporting portion 160 on an outside 167. For example, a wall thickness of the wing or wings 170 may be at most half, advantageously at most one third, of a diameter of the cylindrical keycap supporting portion 160.

In the assembled state of the key module 100, the guiding portion 165 is accommodated in an accommodating bowl 175 of the housing element 130, wherein the accommodating bowl comprises recesses not illustrated in FIG. 1 for accommodating one wing 170 of the guiding portion 165 of the tappet 105 each, as will be explained in greater detail in the following. The guiding portion 165 may also be formed as a hollow-cylindrical portion 180 on the outsides 67 of which the wing or wings 170 are arranged. In the assembled state of the key module 100, for example, a guiding piston in the accommodating ball 175 engages this hollow-cylindrical portion 180 so that the guiding portion 165 can be guided very robustly when the tappet 105 is being moved or depressed.

By using the tappet 105 with the keycap supporting portion 160, which projects through an advantageously circular opening of the cover element 110, the tappet 105 can be guided with as little canting as possible when the tappet 105 is being depressed. This low-canting guidance of the tappet 105 when being depressed can be enhanced further if the wing (or wings) 170 of the guiding portion 165 of the tappet 105 engage the recess(es) of the accommodating ball 175, and thus can ensure both guidance of the tappet 105 the direction of the movement during depressing and guidance with respect to rotation. Hereby, very low-canting actuation of the tappet 105 of the key module 100 can be ensured.

Figure 2:
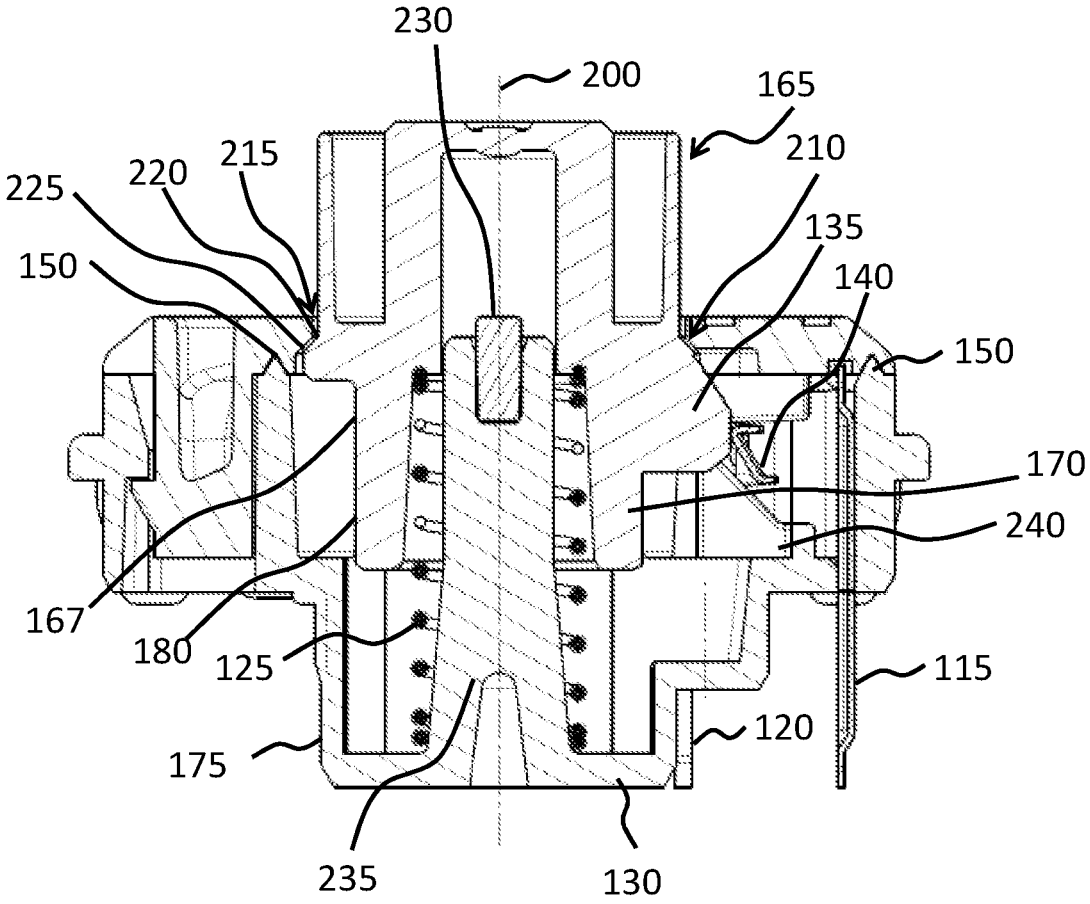
FIG. 2 shows a cross-sectional illustration of a module variant of a key module 100 with linear force-displacement characteristic.

FIG. 2 shows a cross-sectional illustration of a module variant of a key module 100 with a linear force-displacement characteristic. The force-displacement characteristic can be realized arbitrarily by adapting or selecting a suitable compression spring 125. From FIG. 2, it can also be seen that the tappet 105 can be moved with respect to the housing element 130 in the direction of a movement access 200. For example, this movement may be effected by depressing the tappet 105, wherein the tappet is again returned to its original position or rest position illustrated in FIG. 2 after a keystroke on the tappet 105 by the reset force of the compression spring 125.

Moreover, it can be seen in FIG. 2 that the tappet 105 has a tappet slope 220, which includes a surface oriented obliquely with respect to the axis CC, in a passage area 210, in which it is guided through opening 215 of the cover element 110. In addition, also the cover element 110 comprises, in the region of the opening 215, a cover slope 225, which includes a surface oriented obliquely with respect to the movement access 200. Especially, the surface of the tappet slope 220 the surface of the cover slope 225 may substantially be aligned in parallel and have a seal effect in the rest position of the key module 100 illustrated in FIG. 2, in order to prevent liquids from entering an inside of the key module 100 as effectively as possible. Furthermore, the key module 100 comprises a shock absorber element 230, which is set on or in a guiding piston 235 of the housing element 130, for example, and which absorbs an impact of the tappet 105 onto this part of the housing element 130. In this way, a reduced-noise variant of the key module 100 can be produced. It is particularly advantageous if a rubber stopper cut from a round ready-made product and inserted in the guiding piston 230 is used as the shock absorber element 230, for example, because such an embodiment can be produced very inexpensively. The guiding piston 235 may also engage the hollow-cylindrical portion 180 of the guiding portion 180 in an assembled state of the key module 100, in order to achieve additional guidance stability of the tappet 105 when being depressed into the housing element 130.

It can also be seen that the cam nose 135 presses on the contact nose 140 by means of an inclined slope when the tappet 105 is being depressed, and deflects the same laterally, which means transversely or perpendicularly with respect to an extension direction of the movement axis 200. In this embodiment, deflection of the contact nose 140 in a direction along the extension direction of the movement axis 200 can be prevented by the base 240.

Figure 3:
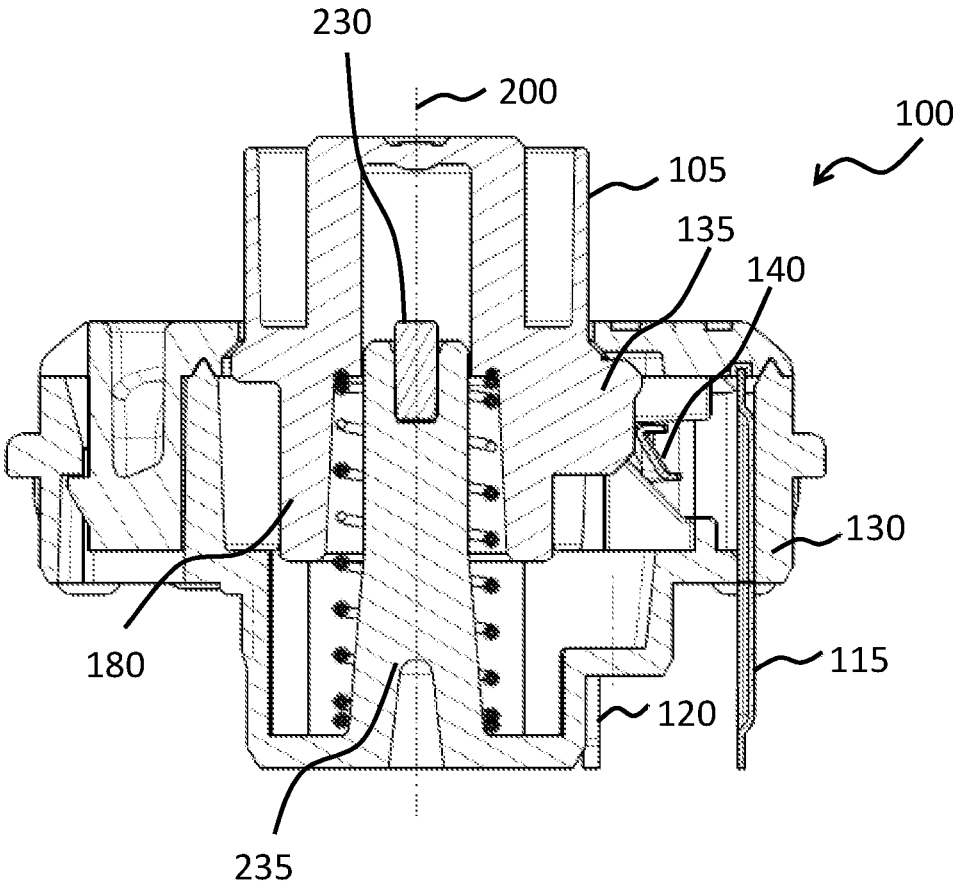
FIG. 3 shows a cross-sectional illustration of a further embodiment of the present invention as a key module.

FIG. 3 shows a cross-sectional illustration of a further embodiment of the present invention as a key module 100, wherein a solution for implementing a pressure point is used in this embodiment. Here, the user of the key module 100 may sense in a tactile manner the crossing of a certain distance of the tappet during the depression. For example, this tactile sensing may be realized by the cam nose 135 comprising a protrusion in the direction of the contact nose 140, and thus the user having to exert increased depressing pressure when depressing the tappet, when the contact nose 140 is to slide around the cam nose 135. The user of the key module 100 feels the increased depressing pressure and thereby recognizes a certain distance by which the tappet 105 has already been depressed. This embodiment, the base 240 may in turn prevent deflection of the contact nose 140 in a direction along the extension direction of the movement axis 200 so that the tactile effect of the protrusion of the cam nose 135 may develop in an optimal way.

Figure 4:
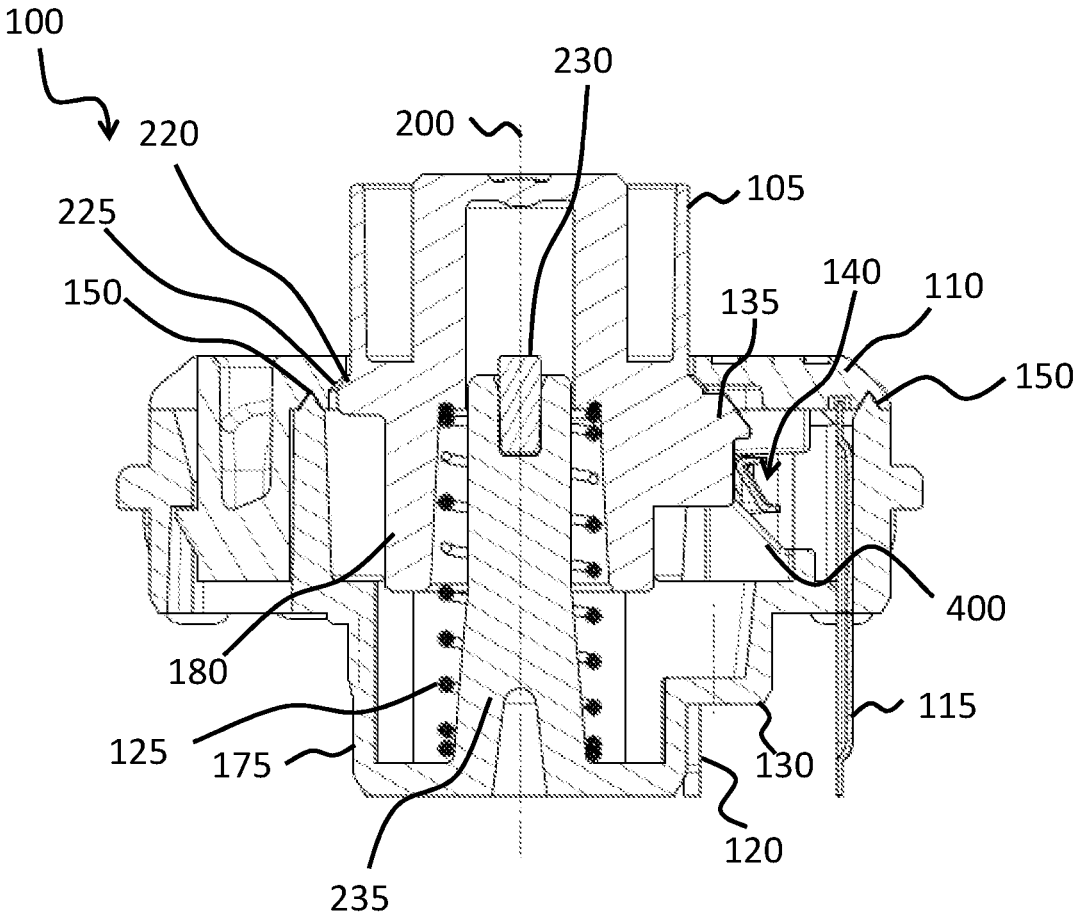
FIG. 4 shows a cross-sectional illustration of a further embodiment of the present invention as a key module.

FIG. 4 shows a cross-sectional illustration of a further embodiment of the present invention as a key module 100, wherein a solution for implementing a pressure and clicking point is used. Hereby, the advantages previously mentioned are achieved in a very efficient way. The actuation of the key module 100 shall be explained in greater detail in the following with reference to the embodiment illustrated in FIG. 4, with it being obvious that the embodiments illustrated in FIGS. 2 to 3 can be used corresponding to the subsequent description.

Particular focus lies on the click variant described with reference to the subsequent figures is an embodiment of a key module 100. In contrast to most solutions known worldwide, in which a clicking sound is produced with an additional part or additional mechanism supplementary to the electric switching mechanism, the clicking sound is induced directly by one of the electric switch contacts, for example by an impact of part of the contactor unit 115 on the cover element 110 or tappet 105, according to the approach presented here. Thus, only the components of the electric switch contacts are necessary as part or component for providing the click and switch function.

According to an embodiment of the approach presented here, the contactor unit 115 is designed so that at least part of the contactor unit 115 can be deflected (actuated) three-dimensionally, like the contact nose 140. The contactor unit 115 is installed in the switch module or key module 100 in a preloaded state so that, for example, gold crosspoint contacts of the contactor unit 115 (forming the contact tip 145, for example) and of the fixed contact or the contact piece 120 are pressed onto each other. With a defined preload, a defined contact force is set in the switched (i.e. electrically connected) state, which remains virtually unchanged over the entire life. This preload or actuation movement takes place in the horizontal plane, i.e. in a direction transverse or perpendicular to the movement axis CC. In particular, this is valid for the linear and pressure point variants of the key module 100 mentioned here.

In the clicker variant according to the embodiment presented here, in which also a clicking sound is produced in addition to the electrical switching, the contactor unit 115 or the contact nose 140 as part of the contactor unit 115 is deflected also in the actuation direction or in the direction of the movement axis 200, which means vertical the corresponding to the illustration in FIG. 4, by means of the actuation nose (i.e. the cam nose 135). Hereby, the contact nose 140 is taken along in the direction of the movement axis 200 by the cam nose 135, wherein the contact nose 140 is preloaded relative to the rest position illustrated in FIG. 4. After a defined actuation or movement distance, the control contour of the contactor unit 115, i.e. the contact nose 140, comes into contact with a guiding wall 400 oblique with respect to the movement axis 200 in the housing element 130 and is deflected transversely to the direction of the movement axis 200 in addition to a vertical movement, i.e. to the right in horizontal direction in the illustration of FIG. 4, by the cam nose 140 upon further actuation.

So as to cause as little friction as possible when the contact nose 140 slides along the guiding wall 400, and also avoid canting and thus malfunction of the key module 100, the contact nose 140 further comprises a surface portion 500 oriented obliquely with respect to the direction of the movement axis 200. Specifically, the surface of the surface portion 500 may be oriented at most at an acute angle to the guiding wall 400, wherein if the surface of the surface portion 500 is aligned in parallel with the guiding wall 400, particularly small sliding resistance can be achieved when the contact nose 140 slides along the guiding wall 400.

Figure 5:
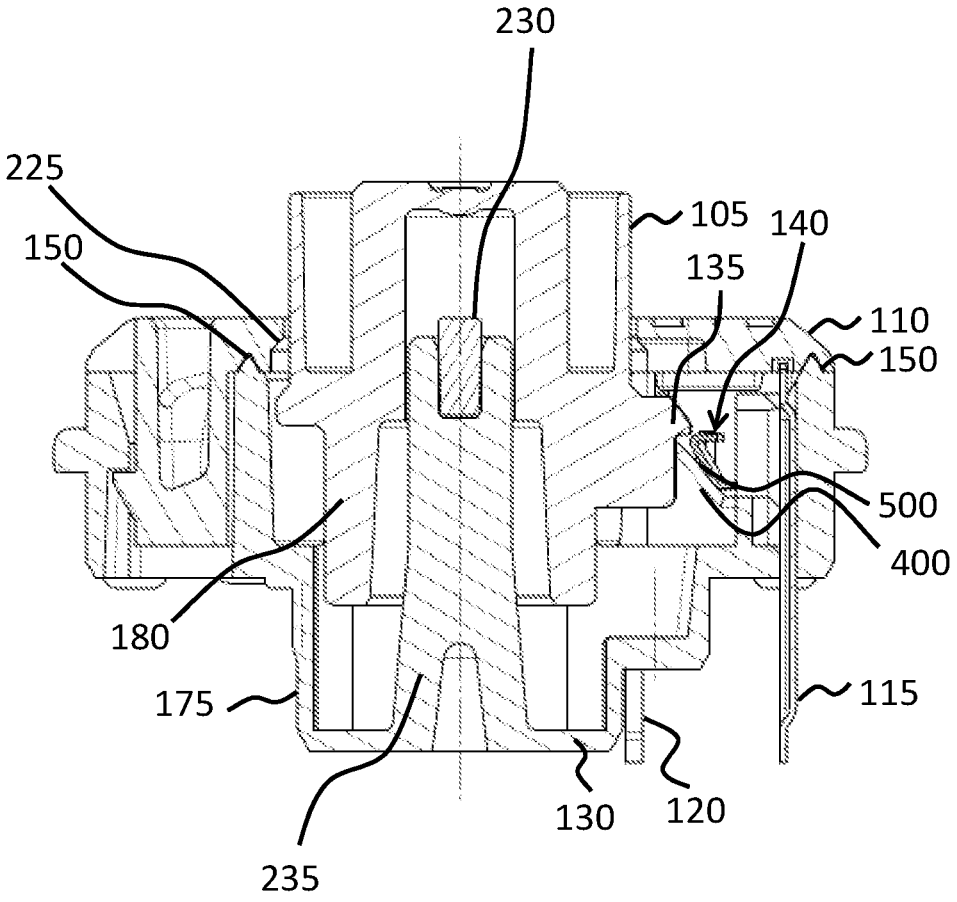
FIG. 5 shows a cross-sectional illustration of a key module according to an embodiment of the approach presented here.

FIG. 5 shows a cross-sectional illustration of a key module 100 according to an embodiment of the approach presented here, wherein the contact nose 140 now is deflected in maximum deflection with reference to the movement axis 200. This means that the distance of the contact nose 142 the movement axis 200 is maximum in this position. In this position illustrated in FIG. 5, the contact nose 140 of the contactor unit 115 will unlatch with respect to the cam nose 135 and be guided around the cam nose 135. For the sake of better overview, the illustration of the compression spring 125 often is omitted in the subsequent figures, with it being obvious that this compression spring 125 can be or is employed in the embodiments of the key module 100 illustrated respectively.

Starting from the point at which the contact nose 140 unlatches, the contactor unit 115 or the contact nose 140 is released again and can return to the original position or rest position both in vertical (which is a longitudinal direction of the movement axis 200) and in horizontal direction in FIG. 5 (which is in a direction transverse to the movement axis 200).

Figure 6:
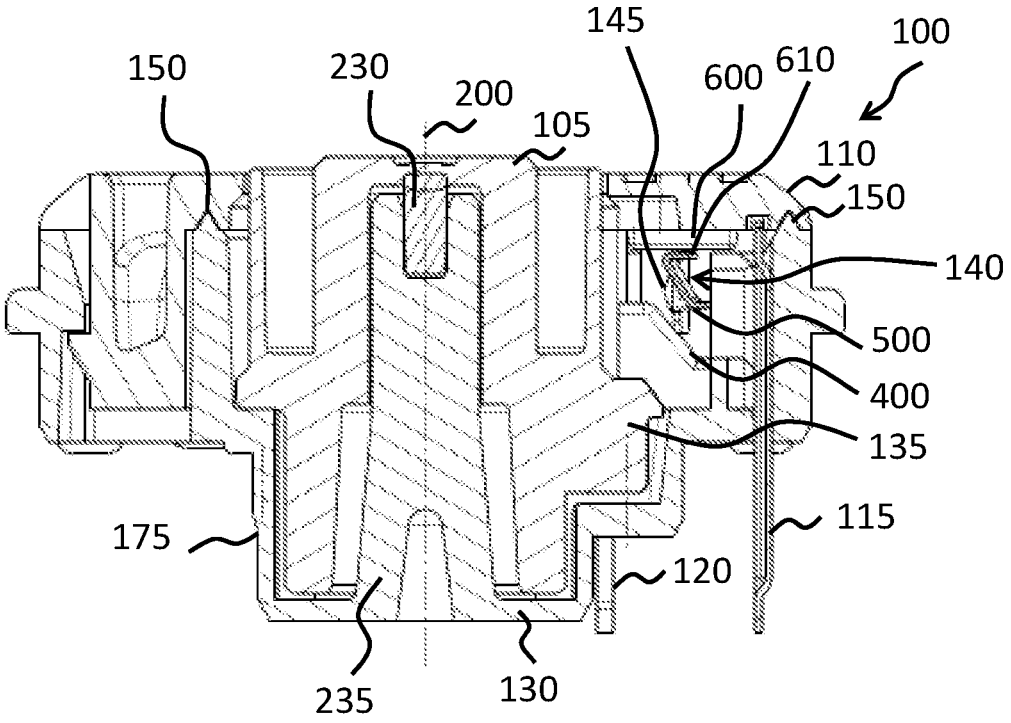
FIG. 6 shows a cross-sectional illustration of the embodiment of the present invention illustrated in FIG. 5 as a key module.

FIG. 6 shows a cross-sectional illustration of the embodiment of the present invention illustrated in FIG. 5 as a key module 100, wherein the contact nose 140 now strikes on a strike wall 600 of the cover element 110 after unlatching and hereby produces a clicking sound. Because the (mechanical) stiffness of the contactor unit 115 has been designed significantly greater in vertical direction than horizontal direction, however, according to the embodiment presented here, the contact nose 140 of the contactor unit 115 first strikes against the strike wall 600 of the cover element 110 with a surface (referred to as strike portion 610 here) defined therefor and produces a desired defined clicking noise. For example, the strike portion 610 may comprise a surface aligned substantially in parallel to the cover element 110 or the strike wall 600 of the cover element 110. Also, the strike portion 610 may be formed by an angled part of the contactor unit 110 or the contact nose 140 and additionally or alternatively may have a greater length of a surface oriented toward the cover element 110 than a thickness.

After the strike of the contactor unit or the contact nose 140 the cover element 110 or the strike wall 610, the contactor unit 110 or the contact nose 140 the horizontal plane, i.e. towards the tappet 105 or the contact piece 120, the electric contact is closed with predefined force.

Figure 7:
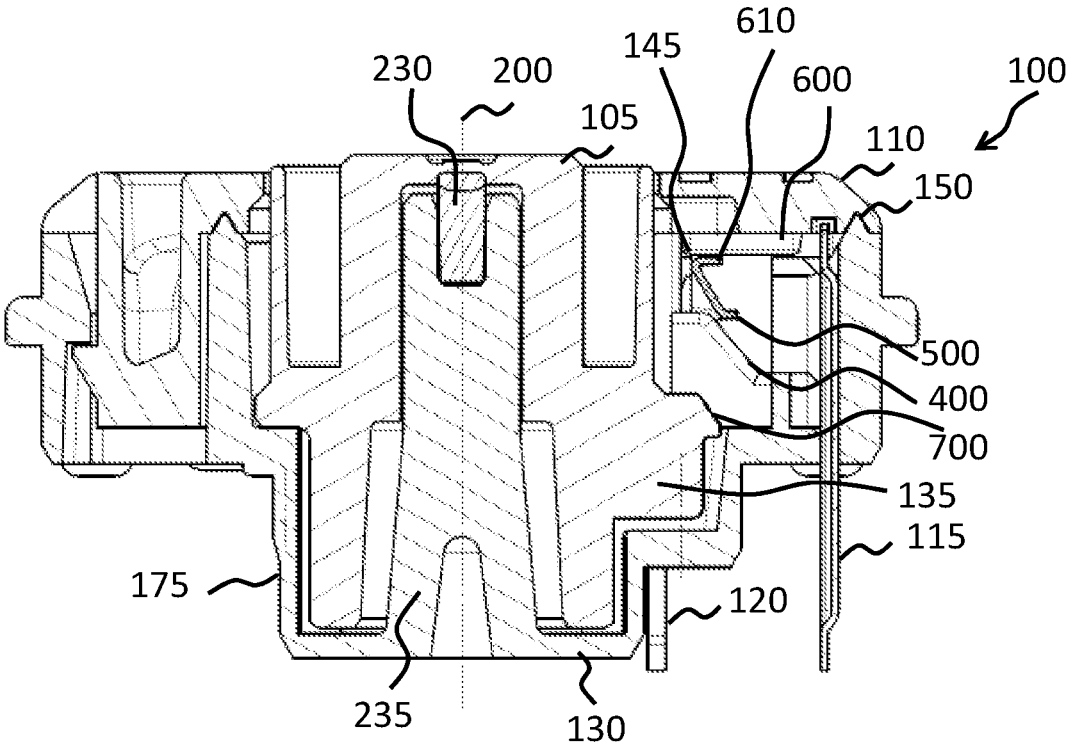
FIG. 7 shows a cross-sectional illustration of the embodiment of the present invention illustrated in FIG. 6 as a key module.

FIG. 7 shows a cross-sectional illustration of the embodiment of the present invention illustrated in FIG. 6 as a key module 100, wherein the contact nose 140 has now again been guided into the rest position after striking on the cover element 110, and thus electric contact between the contact tip 145 of the contactor element 115 and the contact piece 120 is closed.

After releasing the tappet 115, due to the reset force of the compression spring 125, which is not illustrated in FIGS. 5 to 9 as previously mentioned for reasons of better overview, the return of the tappet 105 to the original position illustrated in FIG. 4 takes place. In this process, the contactor unit 115 of the contact nose 140 is deflected in the right direction from FIG. 7, i.e. horizontally or transversely to the direction of the movement axis 200, by a reset surface portion 700 of the cam nose 135 formed as a slope of the tappet 105. Here, the contact nose 140 slides over the actuation nose or cam nose 135, strikes again, but on the tappet 105, and produces a second clicking noise, which may be less intensive than the first clicking noise, for example, which will be due to the contact nose 140 striking on the cover element 110.

Figure 8:
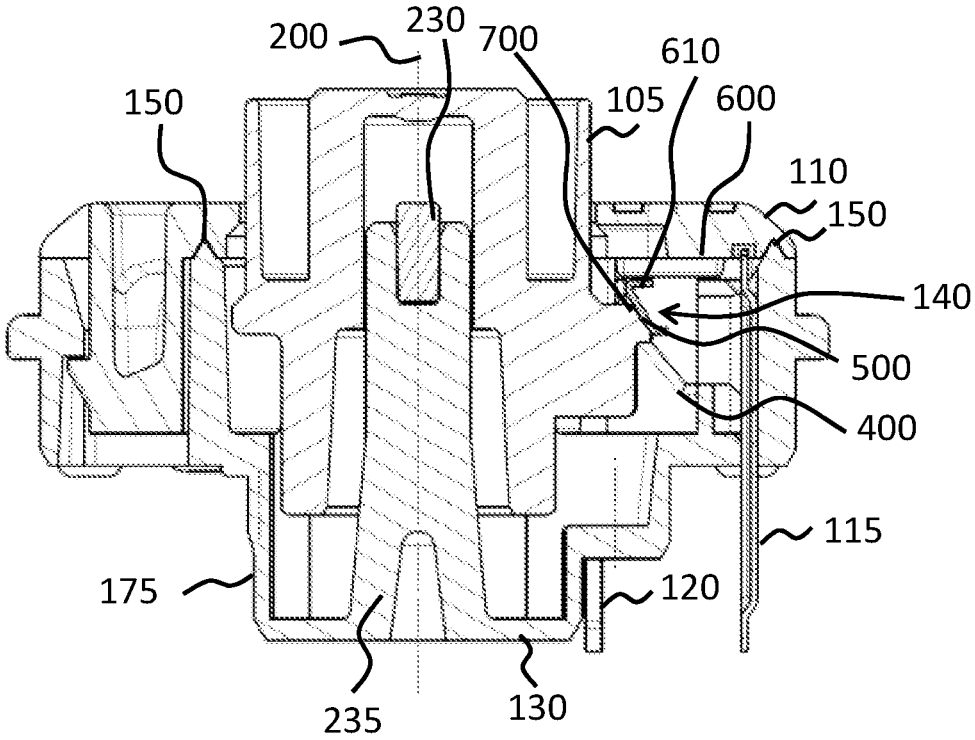
FIG. 8 shows a cross-sectional illustration of the embodiment of the present invention illustrated in FIG. 7 as a key module.

FIG. 8 shows a cross-sectional illustration of the embodiment of the present invention illustrated in FIG. 7 as a key module 100, wherein the contact nose 140 now is deflected to the right, i.e. transverse to the extension direction of the movement axis 200, by the reset surface portion 700 to bring the tappet 105 again to the original position or initial position or rest position.

The sound and the intensity of the clicking sound may be adjusted arbitrarily by the deflection path, material properties of the contactor unit 115, distance to the strike surface 610, stiffness and weight of the contactor unit or the contact nose 140.

Due to the small constructional height of the embodiment of the key module 100 presented here, it is useful to enhance the anti-canting protection of the actuation guidance for the actuation or the depression of the tappet 105 in the key module 100. In order to achieve this with limited length of a guiding device for guiding the movement of the tappet along the movement axis 200, the lower guidance, i.e. a guiding device in the region of the housing element 130, should be designed to be as narrow as possible (for example about 1 mm) and the upper guidance, i.e. a guiding device in the region of the cover element 110 or the tappet 105, to be as wide as possible (to a certain degree). This poses a technical challenge because a guiding pin (usual design) with a diameter of 1 mm does not exhibit sufficient strength (for example in the case of providing a design of plastics material) and, if necessary, would have to be manufactured in a very costly manner from special materials. For this reason, the tappet 105 according to the embodiment presented here with designed such that the upper guidance in the region of the tappet 105 takes on a cylindrical shape with great diameter (which is easy to manufacture).

Figure 9:
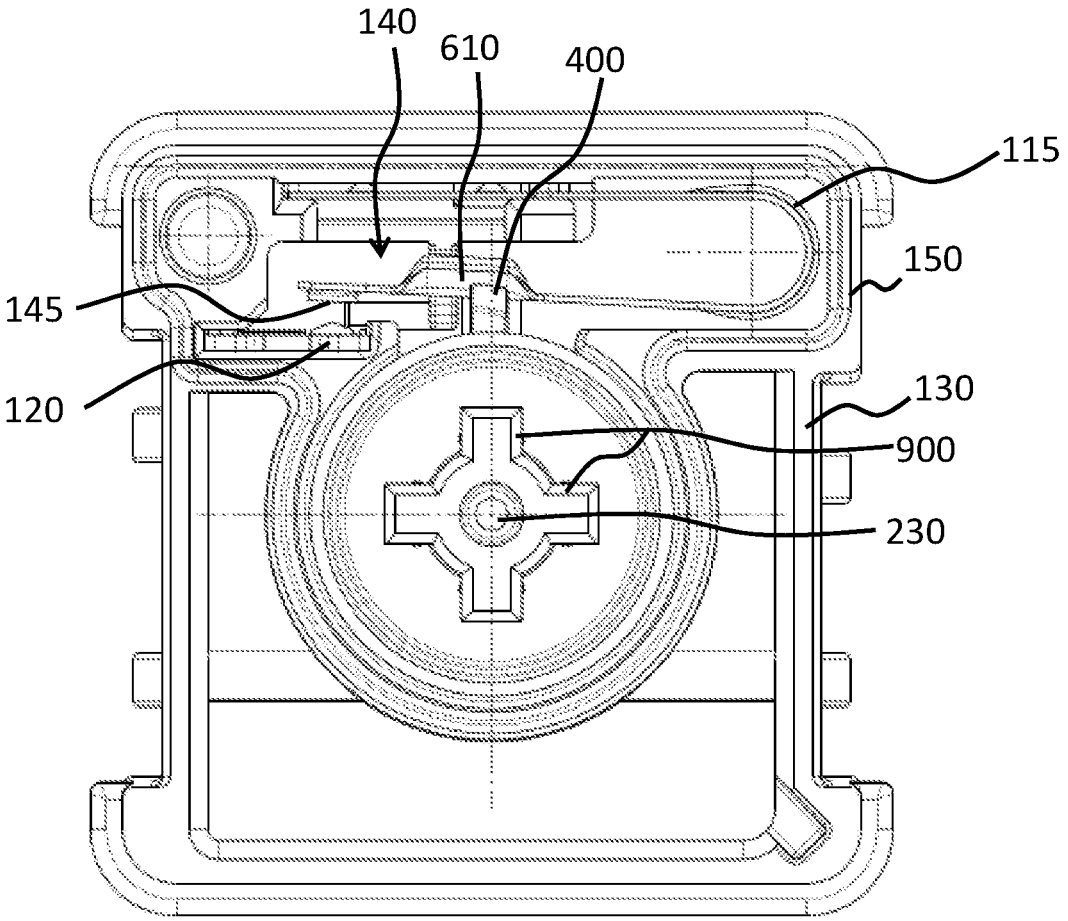
FIG. 9 shows a top view of an embodiment of the present invention as a key module.

FIG. 9 shows a top view of an embodiment of the present invention as a key module 100, wherein FIG. 9 represents a top view onto an open housing element 130 without a cover element 110 being clipped on, but with inserted tappet 105. In addition to the housing element 130, the contact piece 120, the contactor unit 115 including contact nose 140 and contact tip 145, the strike portion 610, the guiding wall 400, the sealing element 150 and the shock absorber element 230 can be seen. Furthermore, what can be seen is the keycap supporting portion 160 of the tappet in top view, wherein keycap support ribs 900 arranged in a cruciform manner and ensuring secure and rotational-locked mounting of the keycaps (which are not illustrated in FIG. 9) to be clipped or stuck on the tappet 105 can be seen.

Figure 10:
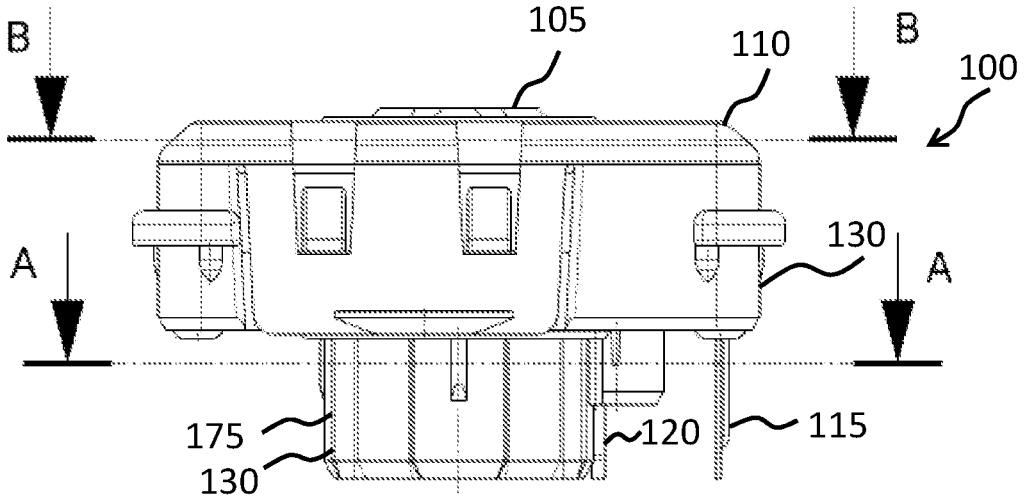
FIG. 10 shows a side view of an embodiment of the present invention as a key module in assembled form.

FIG. 10 shows a side view of an embodiment of the present invention as a key module 100 in the assembled form, i.e. with cover element 110 and housing element 130 clipped together and the further components arranged therein, according to the preceding embodiments. Here, the key module 100 is illustrated in the depressed state, which is the actuated state. What is also illustrated is the layers of a first section A-A and of a second section B-B through the key module 100, the sectional views of which will be explained in greater detail in the subsequent embodiments.

Figure 11:
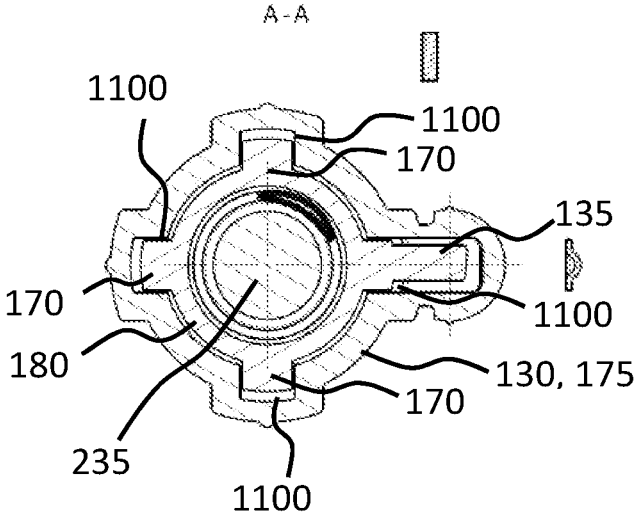
FIG. 11 shows a sectional view through the key module corresponding to the section A-A from the illustration according to FIG. 10.

FIG. 11 shows a sectional view through the key module 100 corresponding to the section A-A from the illustration according to FIG. 10. Since wings 170 are placed on a stable cylindrical sleeve, the outside 167 of the guiding portion 165 of the tappet 105, which engage at least one (or several) recesses 1100 of the accommodating ball 175 of the housing element 130, the overall stiffness of the tappet 105 also is given in usual material designs. Moreover, the protection against rotation of the tappet 105 is realized by the cruciform guidance of the wings 170 engaging the recesses 1100. The lower guidance thus was designed in the guiding portion 165 in the housing element 130 as recesses 1100 for ribs (which may also be referred to as wings 170) of the tappet 105, which specifically are oriented in a cruciform way and provided with a wing width of about 1 mm, for example. The guidance of the tappet 105 here takes place on the side surfaces of the wings 170 arranged in cruciform way in the recesses 1100 of this guiding portion 165. Thus, in both main stress directions, the guidance which is are equal to the thickness of the wings 170 arranged in cruciform way, which is about 1 mm, for example.

Figure 12:
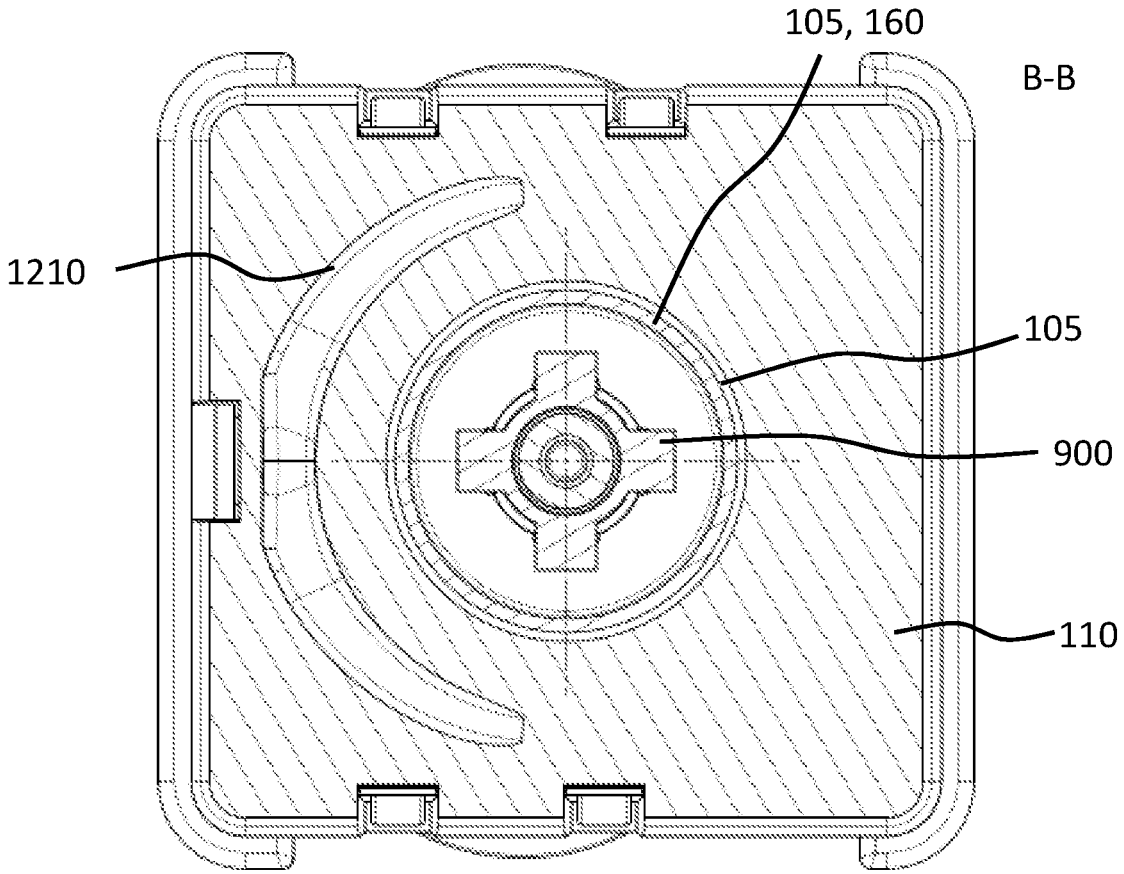
FIG. 12 shows a sectional view through the key module corresponding to the section B-B from the illustration according to FIG. 10.

FIG. 12 shows a sectional view through the key module 100 corresponding to the section B-B from the illustration according to FIG. 10. What can be seen in addition to the cover element 110 is the tappet 105, wherein the keycap supporting ribs 900 in form of ribs arranged in a cruciform way and to which a keycap not illustrated in FIG. 12 can be stuck are also illustrated. What also can be seen is a light guiding element 1210 of the cover element 110, which is arranged in an at least partially annular way around an opening 215 through which the tappet 105 is guided. This light guiding element 1210 serves to improve the illumination of the keycap. Here, the light guiding element 1210 is designed such that it extends from the cover element 110 (from out of the plane of projection according to the illustration from FIG. 12, for example) and is formed of transparent material. In particular, the light guiding element 1210 may project through the cover element 110 on the opposite side of the light source and be designed to be transparent so that, on the back side of the cover element 110 illustrated in FIG. 12, the light guide element 1210 also is integrated in an inexpensive manner as an at least partially round, designed to be round around the tappet 105, in order to be able to emit light as uniformly as possible onto a keycap clipped on the tappet 105. So as to transport a light to a side opposite the cover element 110, the preferably at least partially annular light guide was integrated as the light guiding element 1210 in the cover element 110 in an inexpensive way.

Figure 13:
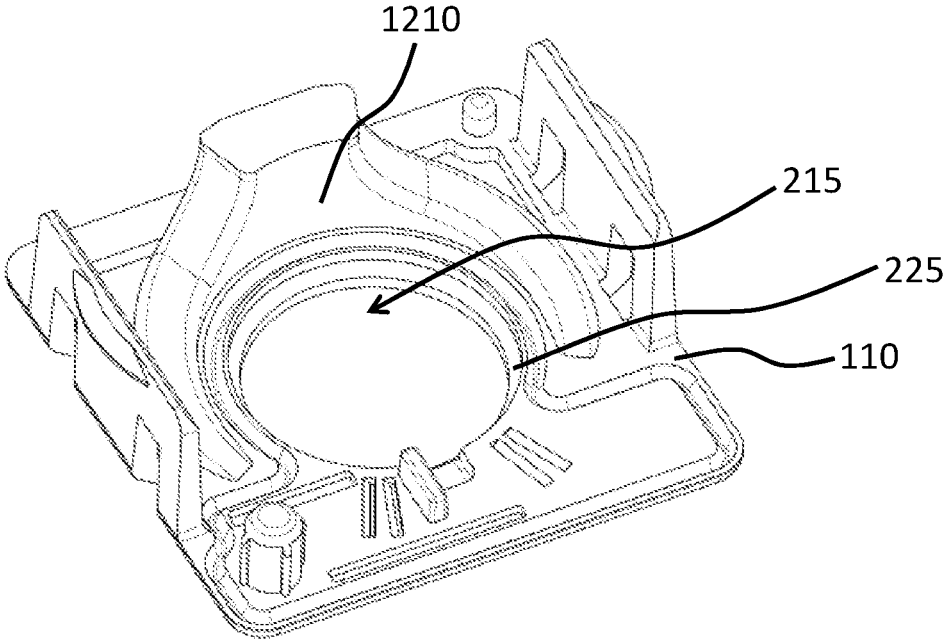
FIG. 13 shows a perspective view of the cover element with the light guiding element integrated therein.

FIG. 13 shows a perspective view of the cover element 110 with the light guiding element 1210 integrated therein. The uniform emission of the light can be designed in various regions of the cover element 110 by introducing reflecting structures or surfaces with different diffusion values on/in the light guiding element 1210 or different positions of the light guiding element 1210.

Figure 14:
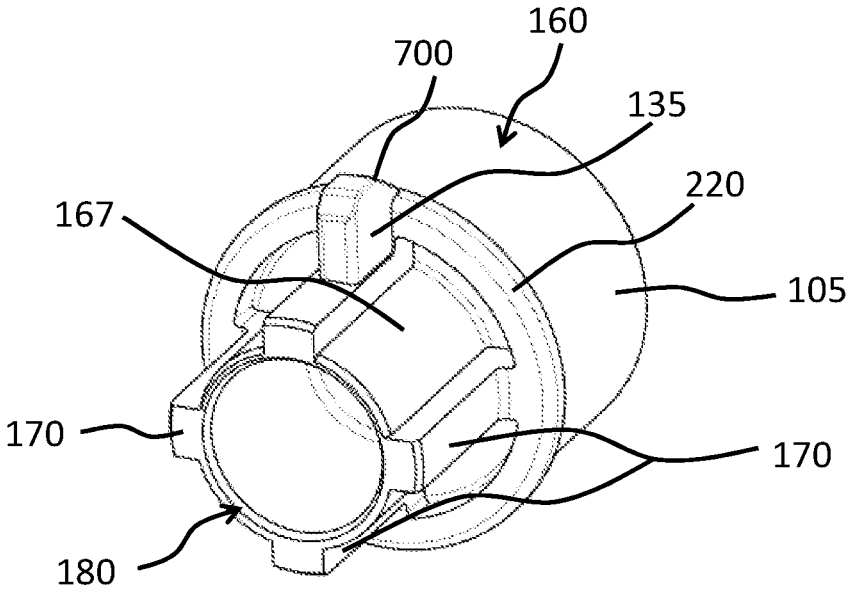
FIG. 14 shows a perspective illustration of the tappet for use in an embodiment of the present invention.

FIG. 14 shows a perspective illustration of the tappet 105 with the wings 1100, the cam nose 135, the reset surface portion 700 and the tappet slope 220.

A relatively good seal with positive locking of the key module 100, at least in the non-actuated state, is ensured by the interface between the cover element 110 with the cover slope 225 and the tappet 105 with the tappet slope 220, which form a conical ring stop. Additionally, in contrast to most known key modules, the upper guidance is formed as a cylindrical holed sleeve, which means a cylindrical guiding portion 160 of the tappet 105, which may be guided in the opening 215. This embodiment prevents the entry of foreign particles and liquids in greater amounts also over the entire actuation path, as already disclosed with reference to FIGS. 4 to 6.

Because it happens every once in a while over the life of a keyboard that aqueous liquids are spilt, a certain resistance of the key modules 100 against the entry of liquids should be ensured at least in the rest position. The switching mechanism, which is the electric contact is such is presently the contactor unit 115 and the contact piece 120, and the components for guiding the tappet 105, in particular the compression spring 125 and the wings 110 and the recesses 900, which would lead to loss of operability of the key module 100 in the case of conglutination, are particularly sensitive to water or sugary liquids, such as coke. For example, the robustness of the key module 100 is improved significantly by introducing a labyrinth seal as sealing element 150 between the cover element 110 and the housing element 130 acting as a base. The labyrinth seal as sealing element 150 protects the entire switching mechanism, which is the contactor unit 115 and the contact piece 120, and the components for the guidance of the tappet 150, as already described with reference to FIGS. 1 and 9, against the entry of liquids, such as water or sugary drinks, and dust in harmful amounts. The aqueous liquids are stopped in the labyrinth seal as sealing element 150 by capillary action so that they do not enter the key module 100.

In certain customer applications, it is desired that the keyboards comprise reduced noise development. Presently, in MX Silent modules of the applicant, for example, costly two-component technology is used. Soft damper elements are sprayed in at certain locations here, in order to reduce noise development in the case of an impact of components to these parts. The manufacture of such a key module 100 thus is very expensive, limited in the selection of materials and requires special tools and processes.

In the approach presented here, a key module 100 is presented in which this issue is provided for by additionally installing a rubber profile as shock absorber element 230 (for example in a round, square, etc. . . . shape) as a damper element in the centering stud as guiding piston 235, for example.

Figure 15:
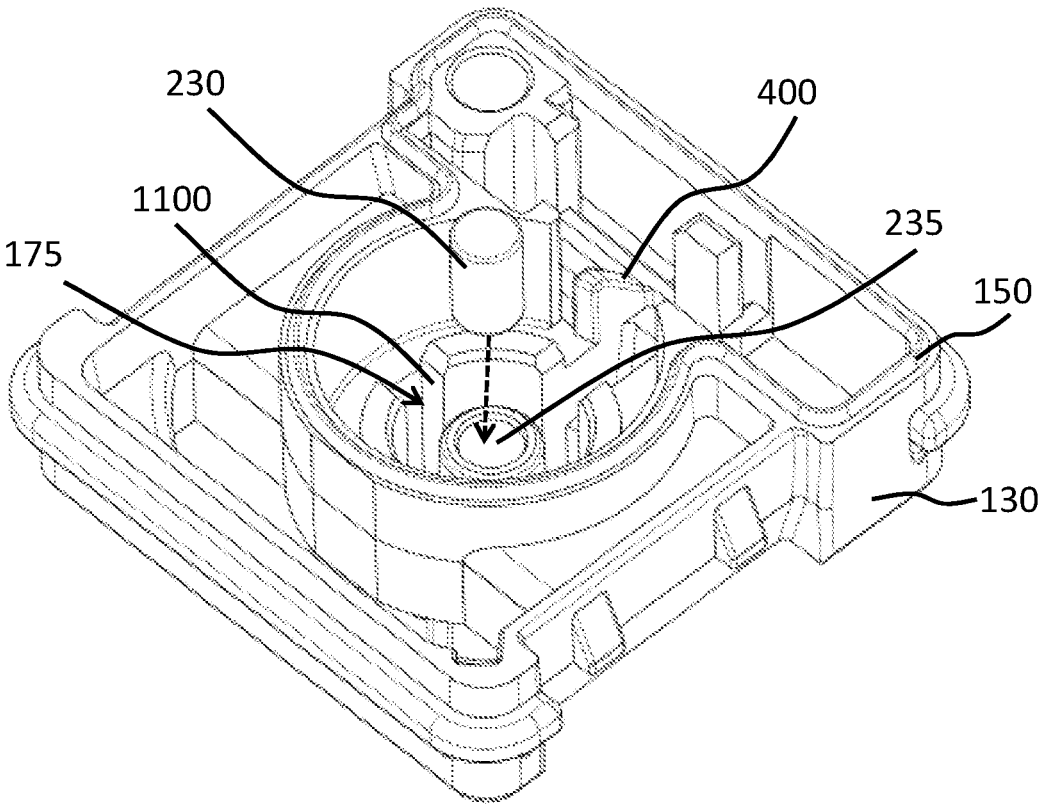
FIG. 15 shows a perspective illustration of a housing element.

FIG. 15 shows a perspective illustration of a housing element 130 with the sealing element 150, the shock absorber element 230, the guiding piston 235 and further components previously mentioned. The shock absorber element 230 may be formed as a rubber damper and may be prefabricated as an endless profile, for example, and cut to the desired length and installed in the guiding piston 235. Optionally, the damper element or shock absorber element 230 may be installed as a disc or ring in the guiding piston 235 between the tappet 105 and the housing element 130. This procedure has several advantages, for example installation may be done according to demand, and no additional tools are needed. Also, a wide selection of materials is available for the shock absorber element 230, and only small overall costs are accrued for providing such an optional shock absorber element 230. Furthermore, an inside view of the housing element 130 with the accommodating bowl 175 and the recesses 1100 arranged in the accommodating bowl 175 can be seen, wherein these recesses 1100 here are provided as complete lateral slit-shaped openings in the accommodating bowl 175.

Figure 16:
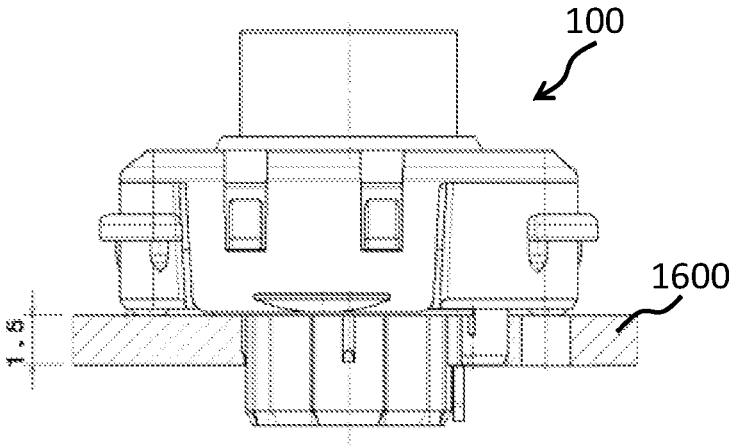
FIG. 16 shows a side view of a key module installed on a circuit board.

FIG. 16 shows a side view of a key module 100, which is installed on a circuit board 1600, such as may be used as a circuit board of a keyboard, for example.

Figure 17:
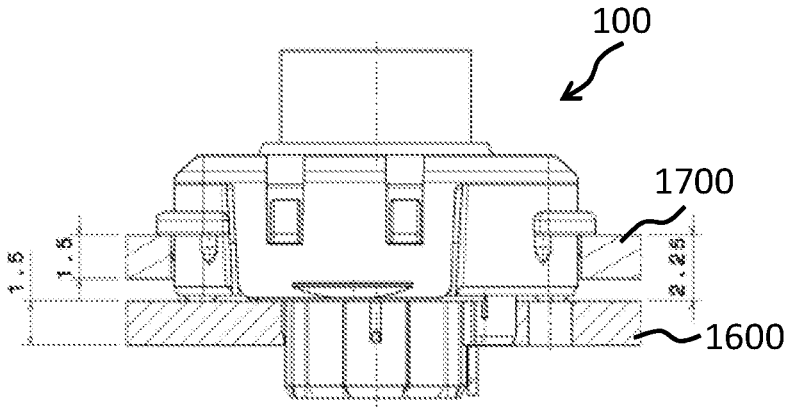
FIG. 17 shows a side view of a further key module also installed on a circuit board.

FIG. 17 shows a side view of a further key module 100, which was also installed on a circuit board, wherein the key module 100 further was stuck through another circuit board as an assembly frame 1700 or is held by this assembly frame 1700 during manufacture. The assembly frame thousand 700 may be used as a retaining circuit board, for example, so as to ensure stable alignment of the key module 100 during the mounting process of the key module 100 on the circuit board 1600. Here, the assembly frame 1700 can be arranged at a small distance above the circuit board 1600.

Reduced construction of the height of the key modules 100 renders the assembly of frequently required electronic devices (for example SMD-based) on the top side of the circuit board as a carrier of the key modules 100 difficult or impossible, in particular in connection with frame assembly. Assembly of the required devices on the bottom side of such a circuit board also is problematic, because certain devices should be attached directly to the key modules 100. This results in considerable difficulties in the subsequent key module soldering process (especially when using a solder wave), because all components need to be covered. Moreover, there is the risk of destruction of the electronic devices due to electrostatic discharge (of up to 8 KV). According to embodiments of the approach presented here, placing SMD devices (for example LEDs, diodes; resistors) below the key module 100 on the top side of the circuit board can be provided as a solution of the problem.

Figure 18:
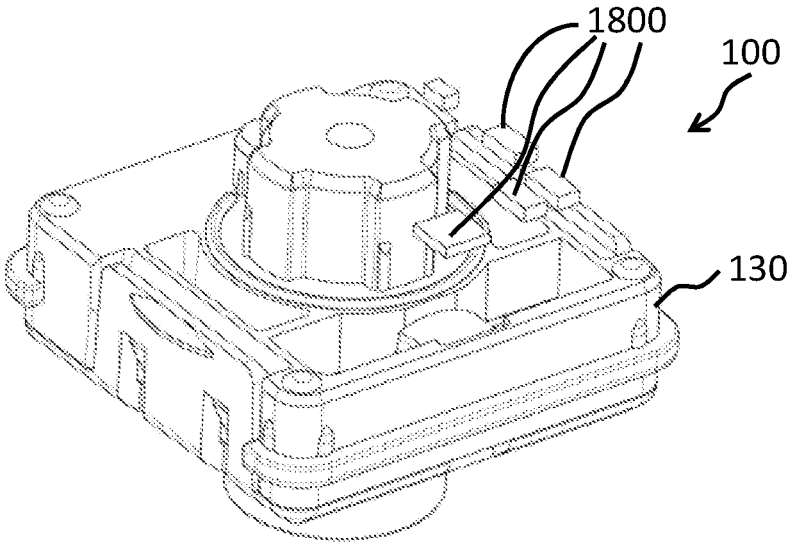
FIG. 18 shows a perspective view on a key module on the housing element.

FIG. 18 shows a perspective view on a key module 100 on the housing element 130. What can be seen is the electronic devices 1800 of the key module 100, which are protected mechanically and against electric discharge by the housing element 130 of the key module 100. A subsequent soldering process can be devised to be inexpensive, because no components need to be placed on the bottom side of the circuit board. The key module 100 can be placed directly on the assembly frame 1700, as can be seen from the illustration of FIG. 16, or be held by means of an additional assembly frame 1700, as can be seen from FIG. 17. In both cases, additional protection against discharge may take place by electrically connecting a protective structure on the top side of the circuit board 1600 or mounting frame 1700 to a ground lead directly or via a discharge resistor (for example 100-300 Ohms).

If an embodiment comprises an "and/or" connection between a first feature and a second feature, this may be read to mean that the embodiment comprises both the first feature and the second feature according to one embodiment and either only the first feature or only the second feature according to a further embodiment.

REFERENCE NUMERALS

100 key module
105 tappet
110 cover element
115 contactor unit
120 contact piece
125 compression spring
130 housing element
135 cam nose
140 contact nose
145 contact tip
150 sealing element
160 keycap supporting portion
165 guiding portion
167 outside
170 wing, rib
175 accommodating bowl
180 hollow-cylindrical portion
200 movement axis
210 passage area
215 opening
220 tappet slope
225 cover slope
230 shock absorber element
235 guiding piston
240 base
400 guiding wall
500 surface portion
600 strike wall
610 strike portion
700 reset surface portion
900 keycap support ribs
1100 recess
1210 light guiding element
1600 circuit board

1700 assembly frame
1800 electronic device

The invention claimed is:

1. A key module comprising:

a cover element, a tappet comprising a cam nose, wherein the tappet is supported to be movable along a movement axis by the cover element, wherein the tappet comprises a cylindrical keycap supporting portion in a passage area in which it projects through the cover element and comprises at least one rib on a guiding portion adjacent to the keycap supporting portion on an outside;

a contactor unit formed and arranged to be taken along by the cam nose;

a contact piece formed and arranged for establishing electric contact with a contact nose; and a housing element for accommodating the contact piece, the contactor unit and the tappet, wherein the housing element comprises, for accommodating the guiding portion of the tappet, at least one accommodating bowl with at least one recess for accommodating the at least one rib of the tappet;

characterized in that the cover element has a cover slope with a surface oblique with respect to the direction of the movement axis in the region of an opening through which the tappet is guided, and/or wherein the tappet has a tappet slope with a surface oblique with respect to the direction of the movement axis in a passage area surrounded by the cover element.

2. The key module according to claim 1, characterized in that the tappet comprises at least a plurality of ribs on its outside, which are arranged in a cruciform manner, wherein the accommodating bowl of the housing element comprises a plurality of recesses, which are each formed to accommodate one of the ribs of the tappet.

3. The key module according to claim 1, characterized in that the tappet comprises an at least partially hollow-cylindrical portion in a region of the guiding portion, wherein the at least one rib is formed on an outside of the hollow-cylindrical portion.

4. The key module according to claim 3, characterized in that a guiding piston of the housing element engages the hollow-cylindrical portion of the guiding portion of the tappet.

5. The key module according to claim 1, characterized in that the at least one rib of the tappet has a wall thickness which at most is half of a diameter of the keycap supporting portion.

6. The key module according to claim 1, characterized by at least one sealing element, which is arranged between the cover element and the housing element, wherein the sealing element is arranged in a groove of the cover element and/or in a groove of the housing element.

7. The key module according to claim 6, characterized in that the sealing element encloses the region of the tappet, the contactor unit and the contact piece in a fluid-tight manner, wherein the sealing element is formed in the shape of a labyrinth seal or as a labyrinth seal.

8. The key module according to claim 1, characterized by a shock absorber element, which is arranged between the tappet and the housing element, wherein the shock absorber element is formed to be cylindrical or annular.

9. The key module according to claim 1, characterized in that the contactor unit comprises a contact nose movable in the direction of the movement axis and transverse to the direction of the movement axis, wherein the housing element comprises a guiding wall oriented obliquely with respect to the direction of the movement axis and formed to deflect the contact nose from a rest position adjacent to the contact piece in the direction along and/or transverse to the movement axis, when the contact nose is taken along by the cam nose when the tappet is being depressed.

10. The key module according to claim 9, characterized in that the housing element is formed to guide the contact nose around the cam nose when the tappet is being depressed.

11. The key module according to claim 9, characterized in that the contactor unit is formed to hit the contact nose on the cover element after a deflection on the guiding wall.

12. The key module according to claim 9, characterized in that the contactor unit comprises an at least partially U-shaped portion, wherein the contact nose is arranged on one end of the U-shaped portion of the contactor unit and/or wherein a U-shape of the contactor unit is formed in a plane substantially perpendicular with respect to the movement axis.

13. The key module according to claim 1, characterized in that the contactor unit has a stiffness greater with respect to movement of the contact nose in the direction of the movement axis than in the direction transverse to the movement axis.

14. The key module according to claim 1, characterized in that the contactor unit has, in the region of the contact nose, a surface portion, the surface of which is oriented obliquely with respect to the direction of the movement axis, the surface of which at most is oriented at an acute angle with respect to a guiding wall.

15. The key module according to claim 1, characterized in that the cover element comprises at least one light guiding element, wherein the light guiding element is formed at least partially annularly around a region in which the tappet is guided through the cover element.

16. The key module according to claim 14, wherein the surface of the surface portion of the contactor unit is aligned in parallel with the guiding wall.

* * * * *